US007739989B2

(12) United States Patent
Kimura et al.

(10) Patent No.: US 7,739,989 B2
(45) Date of Patent: Jun. 22, 2010

(54) VALVE-OPERATING MECHANISM FOR INTERNAL COMBUSTION ENGINE

(75) Inventors: Yasunari Kimura, Wako (JP); Tsuneo Endoh, Wako (JP); Makoto Uda, Wako (JP); Atsushi Baba, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 507 days.

(21) Appl. No.: 11/703,141

(22) Filed: Feb. 7, 2007

(65) Prior Publication Data

US 2007/0181112 A1 Aug. 9, 2007

(30) Foreign Application Priority Data

Feb. 8, 2006 (JP) ..... P2006-031615
Feb. 8, 2006 (JP) ..... P2006-031648
Feb. 8, 2006 (JP) ..... P2006-031663

(51) Int. Cl.
*F01L 1/18* (2006.01)

(52) U.S. Cl. ..... 123/90.39; 123/90.16; 123/90.15

(58) Field of Classification Search ..... 123/90.39, 123/90.16, 90.24, 79 C, 90.15
See application file for complete search history.

(56) References Cited

U.S. PATENT DOCUMENTS 3,881,459 A 5/1975 Gaetcke
2005/0098137 A1* 5/2005 Tanaka et al. ..... 123/188.3

FOREIGN PATENT DOCUMENTS

| | | | |
|---|---|---|---|
| DE | 4128328 | | 1/1992 |
| FR | 991274 | | 10/1951 |
| FR | 2527682 | | 12/1983 |
| JP | 55093915 | A * | 7/1980 |
| JP | 59-37213 | A | 2/1984 |
| JP | 60175713 | | 9/1985 |
| JP | 7-77018 | A | 3/1995 |
| JP | 2000-73803 | A | 3/2000 |
| JP | 2000-297655 | A | 10/2000 |
| JP | 2005-23831 | A | 1/2005 |

* cited by examiner

*Primary Examiner*—Zelalem Eshete
(74) *Attorney, Agent, or Firm*—Birch, Stewart, Kolasch & Birch, LLP

(57) ABSTRACT

A valve-operating mechanism for an internal combustion engine having intake and exhaust valves and valve control members for controlling the intake and exhaust valves. The intake and exhaust valves are configured as dual valves having an outer valve and an inner valve. The valve control members, at least during scavenging, simultaneously close the outer valves of the intake and exhaust valves, producing a non-overlapping state, and simultaneously open the inner valves of the intake and exhaust valves, producing an overlapping state.

8 Claims, 13 Drawing Sheets

VALVE-OPERATING MECHANISM FOR INTERNAL COMBUSTION ENGINE

FIELD OF THE INVENTION

The present invention relates to a valve-operating mechanism for an OHV internal combustion engine having a pushrod.

BACKGROUND OF THE INVENTION

An internal combustion engine in which the surface area of the portion for generating squish has been increased is proposed in Japanese Patent Laid-Open Publication No. 2005-23831, for example. A valve-operating mechanism for an internal combustion engine in which the intake and exhaust valves do not overlap in the vicinity of top dead center when the exhaust stroke has been completed is proposed in Japanese Patent Laid-Open Publication No. 2000-73803, for example. A valve-operating mechanism for an internal combustion engine in which the intake and exhaust valves each have a dual structure is proposed in Japanese Patent Laid-Open Publication No. 7-77018, for example.

Japanese Patent Laid-Open Publication No. 2005-23831 describes a structure in which intake valves are disposed in the cylinder head, a recess is formed in a portion of the top of the piston so as to face one of the intake valves, and the space between the cylinder head and the top of the piston excluding the recess forms a squish area that has a large surface area. Such a large squish area facilitates the generation of squish and improves combustion.

The exhaust valve is not described, but the exhaust valve and intake valves ordinarily open in an overlapping state in the vicinity of top dead center in the exhaust stroke. In this overlapping state, fresh air that has been momentarily drawn in has a scavenging effect whereby residual gases are driven out, but adequate scavenging effect cannot be performed due to the inertia of the air intake and exhaust gas as the engine speed increases. The scavenging state is expressed as ratio of the mass of the fresh air remaining in the cylinder prior to combustion relative to the mass of the fresh air fed into the cylinder in a single cycle, i.e., is expressed as the trapping efficiency. Since the trapping efficiency directly affects engine performance, it is preferable to perform adequate scavenging while expanding the above-described squish area.

Japanese Patent Laid-Open Publication No. 2000-73803 describes a configuration in which the exhaust valve and intake valve are set in an overlapping state by closing the exhaust valve after air intake top dead center and opening the intake valve prior to air intake top dead center when the engine is under a high load; and the exhaust valve and intake valve are set in a non-overlapping state by closing the exhaust valve prior to air intake top dead center when the engine is under a low load.

Under a high engine load, the exhaust valve and intake valve are in an overlapping state, but since the amount of overlap is small, it is difficult to reliably carry out scavenging when the engine is operating at high speed.

In view of the above, it is possible to consider increasing the overlap amount and the valve lift distance. However, the intake and exhaust valves are liable to interfere with the top of the piston, and valve recesses in the top of the piston become necessary. Accordingly, the surface area of the squish area is reduced.

Japanese Patent Laid-Open Publication No. 7-77018 describes a configuration in which the intake valve is composed of an outer valve and an inner valve movably inserted inside the outer valve, a port is opened and closed by the outer valve, and a vent disposed in the outer valve is opened and closed by the inner valve. The outer valve is opened and closed by a rocker arm, and the inner valve opens when the interior of the combustion chamber has reached a prescribed negative pressure. The exhaust valve has the same structure as the intake valve.

The timing for opening and closing the inner and outer valves of the intake valve is not described, and the overlapping state of the intake and exhaust valves in the vicinity of top dead center of the exhaust stroke is not clear.

In view of the above, there is a need to expand the squish area as well as more reliably perform scavenging in the vicinity of the exhaust stroke in the high-speed region of an internal combustion engine.

A valve-operating mechanism for an internal combustion engine in which the intake and exhaust valves are radially disposed about a point on the center axis of the cylinder is proposed in Japanese Patent Laid-Open Publication No. 59-37213, for example.

Japanese Patent Laid-Open Publication No. 59-37213 describes a configuration in which the valve stems of two intake valves and two exhaust valves are radially disposed in the cylinder head about the center axis of the cylinder.

For example, the two intake valves are mounted in the cylinder head at a prescribed valve-included angle. Therefore, when the two intake valves open simultaneously, the outside diameter of the valve head and the lift distance are limited so that the intake valve does not interfere with the cylinder head, and it is difficult to increase the intake amount.

In view of this situation, there is a need to increase the amount of air intake in an internal combustion engine.

A valve-operating mechanism for an internal combustion engine that allows high speed rotation is proposed in Japanese Patent Laid-Open Publication No. 2000-297655.

The engine described in Japanese Patent Laid-Open Publication No. 2000-297655 has a crankshaft and camshaft rotatably mounted in the crankcase, a timing drive gear mounted in the crankcase, and a timing driven gear mounted on the camshaft. An idler gear meshes with the timing drive gear and timing driven gear. The cylinder head has intake valves and exhaust valves, valve springs that urge the intake and exhaust valves in the closing direction, rocker arms that press against the ends of the intake and exhaust valves to open and close the valves, and pushrods disposed between the rocker arms and the cams of the camshaft.

The idler gear is disposed on the cylinder head side of the crankshaft, and the camshaft can therefore be disposed on the cylinder head side. Therefore, the weight of the pushrod is reduced in an amount commensurate with the shortened pushrod, and the engine can be operated at higher speeds.

With the valve-operating mechanism for the engine described above, an increase in speed is restricted by resonance in the valve springs in the high-speed region or by other factors because the structure is one in which the intake and exhaust valves are closed by the valve spring.

In order to allow the camshaft to rotate, space for accommodating the idler gear must be provided inside the crankcase because of the added idler gear. This increases the size of the crankcase and consequently leads to an increase in the size of the engine. The complexity of the internal structure of the crankcase is increased and a structure for supporting the idler gear in the crankcase is required.

In view of the above, there is a need to increase the speed and reduce the size of an internal combustion engine, and make the structure more compact and simple.

SUMMARY OF THE INVENTION

According to a first aspect of the present invention, there is provided a valve-operating mechanism for an internal combustion engine having a cylinder head, a combustion chamber, and intake and exhaust ports, which comprises: intake and exhaust valves adapted to be disposed in the cylinder head for respectively opening and closing the intake and exhaust ports which are designed to communicate with the combustion chamber, the intake and exhaust valves being configured as dual valves having an outer valve and an inner valve, the outer valve having an inner valve aperture extending axially thereof, the inner valve being movably fitted in the inner valve aperture, the outer valve having an inner channel that allows communication between the combustion chamber and the intake and exhaust ports, the inner channel being opened and closed by the inner valve; and valve control members for controlling the opening and closing of the outer valve and inner valve, the valve control members, at least during scavenging, simultaneously closing the outer valves of the intake and exhaust valves to produce a non-overlapping state, and simultaneously opening the inner valves of the intake and exhaust valves to produce an overlapping state.

In this manner, the outer valves of the intake and exhaust valves are simultaneously closed at least during scavenging to obtain a non-overlapping state, and the inner valves of the air intake and exhaust are opened simultaneously to obtain an overlapping state, whereby the vicinity of top dead center in a high-speed region can be reliably scavenged, a valve recess in the top of the piston can be eliminated to increase the squish area, and engine performance and combustion efficiency can be improved.

According to a second aspect of the present invention, there is provided a valve-operating mechanism for an internal combustion engine having a cylinder head, a combustion chamber, and intake and exhaust ports, which comprises: intake and exhaust valves adapted to be disposed in the cylinder head for respectively opening and closing the intake and exhaust ports that communicate with the combustion chamber, the intake and exhaust valves being configured as dual valves having an outer valve and an inner valve, the outer valve having an inner valve aperture extending axially thereof, the inner valve being movably fitted in the inner valve aperture, the outer valve having an inner channel that allows communication between the combustion chamber and the intake and exhaust ports, the inner channel being opened and closed by the inner valve; and valve control members for controlling the opening and closing of the outer valve and inner valve, the valve control members respectively opening the outer valve and the inner valve of the exhaust valve in an exhaust stroke and respectively opening the outer valve and inner valve of the intake valve in an intake stroke.

In this manner, the outer and inner valves of the exhaust valve are opened in the exhaust stroke, and the outer and inner valves of the intake valve are opened in the intake stroke, whereby the effective aperture surface area of the intake and exhaust valves can be expanded, the intake amount can be increased, and engine performance can be improved.

According to a third aspect of the present invention, there is provided a valve-operating mechanism for an internal combustion engine having a cylinder with a head, a combustion chamber, and intake and exhaust ports, which comprises: a plurality of intake valves and an exhaust valve adapted to be disposed in the cylinder head radially relative to an axis of the cylinder for respectively opening and closing the intake and exhaust ports communicating with the combustion chamber; and valve control members for preventing interference between the intake valves by controlling the opening and closing of the intake valves using different valve timings and different lift distances, respectively.

In this manner, valve control members are provided for preventing interference between the plurality of intake valves by controlling the opening and closing of the plurality of intake valves using different valve timings and different lift distances, respectively. Therefore, interference of each intake valve can be prevented, and the valve lift distance can be increased. Also, the valve-included angle and valve diameter can be increased. The aperture surface area of the intake valve can thereby be expanded, the intake amount can be increased, and the output of an internal combustion engine can be improved.

Furthermore, by increasing the valve-included angle, the distance between the intake valve and the combustion chamber wall can be increased, the effective aperture surface area of the intake valve can be expanded, and the intake amount can be further increased when the intake valve has opened.

Preferably, either of the intake valves and the exhaust valve has a head portion of non-circular shape. The aperture surface area can thereby be expanded and the intake amount can be further increased.

Desirably, the intake valves and exhaust valve are each configured as dual valves having an outer valve with an inner valve aperture extending axially therethrough, and an inner valve movably fitted in the inner valve aperture, the outer valve having an inner channel for allowing communication between the combustion chamber and the intake and exhaust ports, the inner channel being opened and closed by the inner valve, and the valve control members controlling the opening and closing actions of the outer valve and the inner valve.

Residual gas remaining in the combustion chamber can thereby be scavenged by fresh air that has been drawn in when the inner valve has been opened and the outer valve has been left closed in the vicinity of top dead center of the piston.

The inner valve whose head portion has a small external outline is not liable to interfere with the top of the piston. Therefore, the lift distance can be extended, the inflow rate of fresh air can be increased, scavenging can be more reliably carried out, and engine output can be improved.

According to a fourth aspect of the present invention, there is provided a valve-operating mechanism for an internal combustion engine having a cylinder head, which comprises: a camshaft adapted to be disposed in the cylinder head and having a valve-opening cam; an exhaust valve adapted to be disposed in the cylinder head; a valve-opening pushrod connected at one end to the camshaft in such a manner as to be driven by the valve-opening cam of the camshaft; a valve-opening rocker arm connected to an opposite end of the valve-opening pushrod and to the exhaust valve and swingably supported by a rocker shaft mounted to the cylinder head; a valve-closing pushrod connected at one end to the camshaft in such a manner as to be driven by a valve-closing cam of the camshaft; and a valve-closing rocker arm connected to an opposite end of the valve-closing pushrod and to the exhaust valve and swingably supported by the rocker shaft, wherein one of the valve-opening pushrod and the valve-closing pushrod is formed cylindrically, the other one of the valve-opening pushrod and the valve-closing pushrod is disposed inside the cylindrical pushrod such that the two pushrods are disposed substantially coaxially, so that rotation of the camshaft is converted via the pushrods and the rocker arms to opening/closing actions of the intake and exhaust valves.

In accordance with the configuration described above, a valve spring is not required and an internal combustion engine can operate at a higher speed. Components do not need to be newly installed to allow an internal combustion engine to operate at a higher speed, and the space for accommodating pushrods can be reduced by disposing the two pushrods in a substantially coaxial manner. Therefore, an internal combustion engine can be reduced in size and made more compact, and the structure can be simplified.

According to a fifth aspect of the present invention, there is provided a valve-operating mechanism for an internal combustion engine having a cylinder head, a combustion chamber, and intake and exhaust ports, which comprises: intake and exhaust valves adapted to be disposed in the cylinder head for respectively opening and closing the intake and exhaust ports adapted to communicate with the combustion chamber, the intake and exhaust valves being configured as dual valves having an outer valve and an inner valve, the outer valve having an inner valve aperture extending axially thereof, the inner valve being movably fitted in the inner valve aperture, the outer valve having an inner channel that allows communication between the combustion chamber and the intake and exhaust ports, the inner channel being opened and closed by the inner valve; and a camshaft adapted to be disposed in the cylinder head, wherein the valve-operating mechanism further comprises: a first rocker shaft; an outer valve cam disposed on the camshaft; an outer valve first rocker arm that makes contact with the outer valve cam for opening and closing the outer valve, the outer valve first rocker arm being swingably supported by the first rocker shaft; an outer valve pushrod connected at one end to the outer valve first rocker arm; a second rocker shaft; an outer valve second rocker arm connected to an opposite end of the outer valve pushrod and to the outer valve and swingably supported by the second rocker shaft; an inner valve pushrod connected at one end to the inner valve first rocker arm; and an inner valve second rocker arm connected to an opposite end of the inner valve pushrod and to the inner valve and swingably supported by the second rocker shaft, the outer valve first rocker arm and the inner valve first rocker arm having respective drive arms for, when one of the rocker arms is driven by the outer valve cam or the inner valve cam, pushing the other one of the rocker arms to drive the same, one of the outer valve pushrod and the inner valve pushrod being formed cylindrically and the other one of the outer valve pushrod and the inner valve pushrod being disposed inside the cylindrical pushrod so that the two pushrod lie substantially coaxially, the outer valve being driven via the drive arms when the inner valve is opened and closed and the inner valve being driven via the drive arms when the outer valve is opened and closed, so that rotation of the camshaft is converted via the pushrods and the rocker arms to opening/closing actions of the intake and exhaust valves.

In accordance with the above-described configuration, the outer and inner valves can be simultaneously opened, the intake amount can be increased, and engine performance can be improved.

Desirably, the valve-operating mechanism further comprising a spring provided between the outer valve and the inner valve for forcibly closing the inner valve against the outer valve.

The inner valve can be reliably closed against the outer valve, and sealing characteristics can be assured.

BRIEF DESCRIPTION OF THE DRAWINGS

Certain preferred embodiments of the present invention will be described in detail hereinafter with reference to the accompanying drawings, in which:

FIG. 11A is a graph showing timing characteristics of an intake valve of a valve-operating mechanism according to a third embodiment of the present invention, while

DESCRIPTION OF THE PREFERRED EMBODIMENTS

Figure 1:
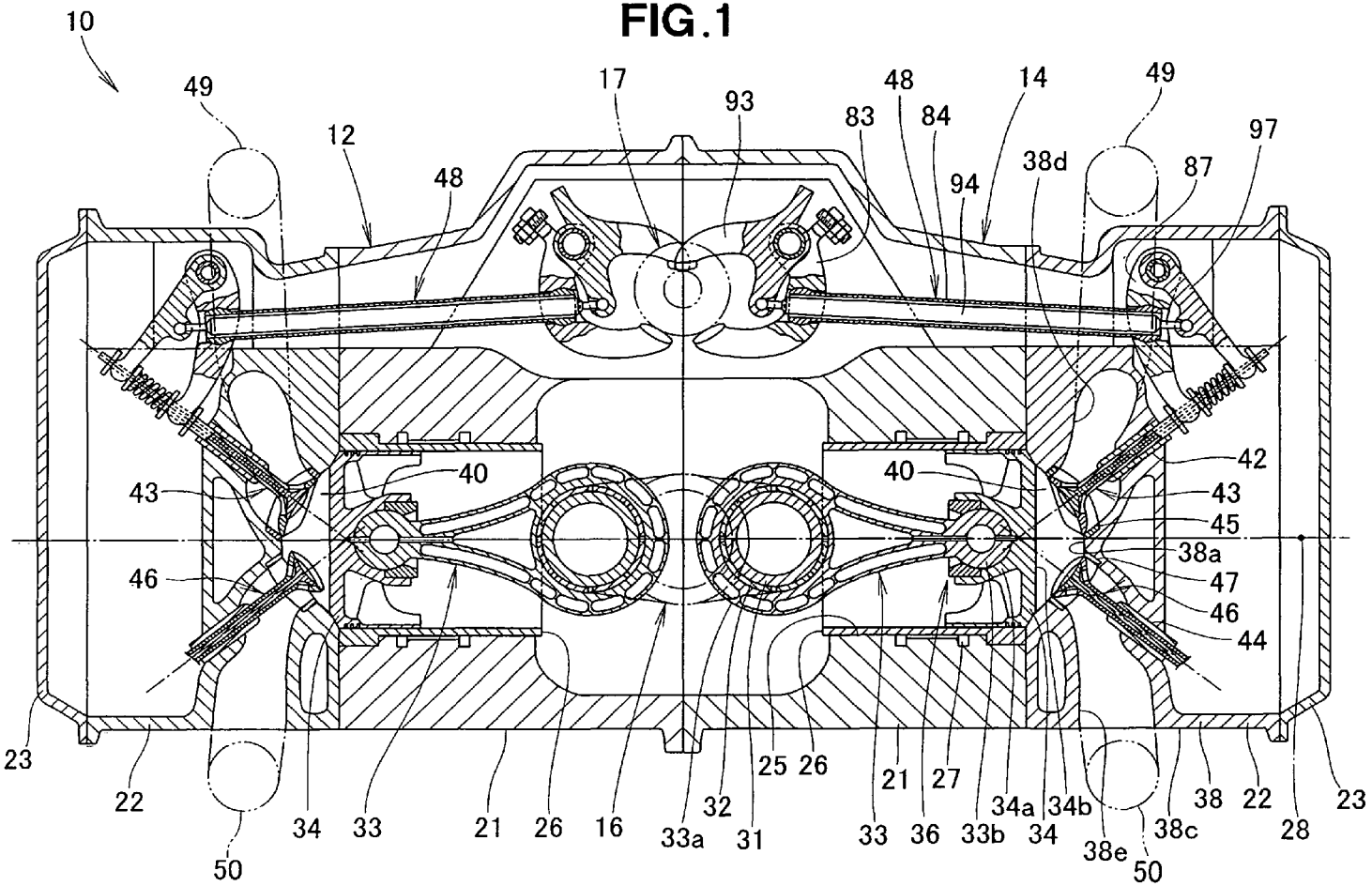
FIG. 1 is a cross-sectional view showing an internal combustion engine employing a valve-operating mechanism according to a first embodiment of the present invention.

As shown in FIG. 1, the internal combustion engine 10 is composed, e.g., of a left cylinder portion 12 as a first cylinder, and a right cylinder portion 14 as a second cylinder, and is an OHV two-cylinder horizontal opposed engine in which a crankshaft 16 and a camshaft 17 are rotatably mounted between the left cylinder portion 12 and right cylinder portion 14.

The left cylinder portion 12 and right cylinder portion 14 have substantially the same structure, and only the right cylinder portion 14 is described below.

The right cylinder portion 14 has a cylinder block 21, a cylinder head 22 mounted at the end of the cylinder block 21, and a head cover 23 that covers the aperture of one end of the cylinder head 22.

The cylinder block 21 is made of an aluminum alloy and is a member having a cast cylinder liner 26 made of cast iron in a hole 25. The reference symbol 27 designates a water jacket formed between the hole 25 and the cylinder liner 26, and 28 is a cylinder axis that passes through the center of the cylinder liner 26.

The crankshaft 16 is a member in which a large end 33*a* of a connecting rod 33 is connected to a crank pin 31 via a bearing 32.

The connecting rod 33 is a member in which an inner connecting portion 34*a* of a piston 34 is connected to a small end 33*b*, and a spherical sliding bearing 36 is composed of the small end 33*b* and the inner connecting portion 34*a*.

The piston 34 is a member that is movably inserted in the cylinder liner 26.

The cylinder head 22 has a concave combustion chamber wall 38*a* in which a head body 38 and the top surface 34*b* of the piston 34 form a combustion chamber 40; an air intake port 38*d* and an exhaust port 38*e* extended from the combustion chamber wall 38*a* to outer walls 38*b* and 38*c* (only reference numeral 38*c* is shown), respectively; an intake valve 43 mounted on the head body 38 via a valve guide 42 so as to allow reciprocating movement in order to open and close the air intake port 38*d*, which is the exit into the combustion chamber 40; and an exhaust valve 46 mounted on the head body 38 via a valve guide 44 so as to allow reciprocating movement in order to open and close the exhaust port 38*e*, which is the entrance from the combustion chamber 40. Reference numeral 45 designates a valve seat of the air intake side, 47 is a valve seat of the exhaust side, 49 is an air intake tube, and 50 is an exhaust tube.

The combustion chamber wall 38*a*, outer walls 38*b* and 38*c*, air intake port 38*d*, and exhaust port 38*e* described above are formed by the head body 38.

The intake valve 43 is caused to perform reciprocating movement by an intake valve operating mechanism 48, and the exhaust valve 46 is a member that is caused to perform reciprocating movement by an exhaust valve operating mechanism (not shown). The exhaust valve operating mechanism has essentially the same structure as the intake valve operating mechanism 48 and is not described here.

Figure 2:
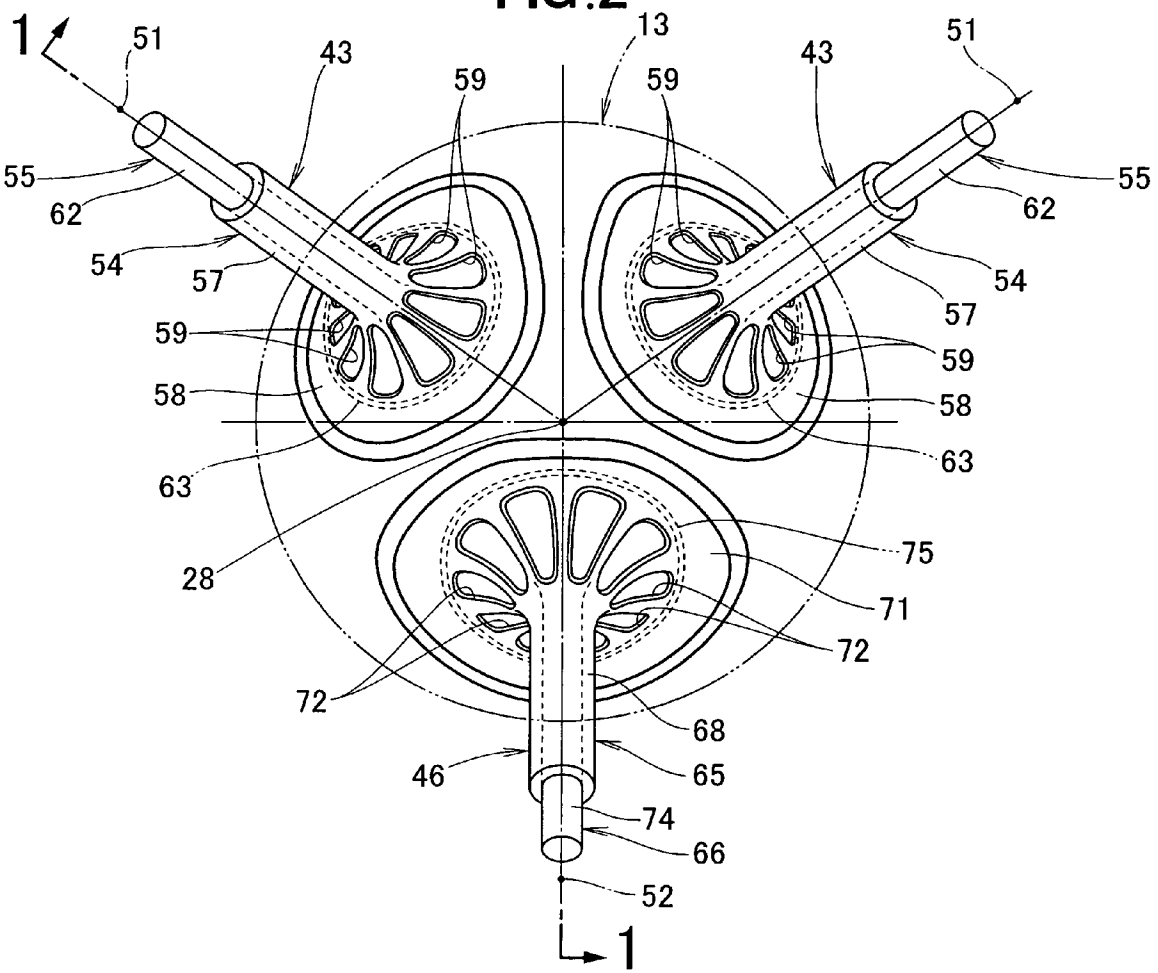
FIG. 2 is a view showing the arrangement of the intake and exhaust valves of the valve-operating mechanism according to the first embodiment of the present invention.

FIG. 2 is a view viewed from the extended direction of the cylinder axis 28 (in this view, the cylinder axis 28 is indicated by a black dot) shown in FIG. 1 (FIG. 1 is cross-sectional view along the line 1-1 of FIG. 2).

The exhaust valve 46 and the two intake valves 43 and 43 are radially disposed so that the axes 51, 51, and 52 of the valves pass through the cylinder axis 28.

The intake valve 43 comprises an outer valve 54 as well as an inner valve 55 movably inserted into the outer valve 54.

The outer valve 54 comprises a shaft 57 and a head 58 integrally formed at the distal end of the shaft 57, and a plurality of vent holes 59 is provided in the head 58. The external outline of the head 58 is not circular.

The inner valve 55 comprises a shaft 62 and a head 63 integrally formed at the distal end of the shaft 62, and the external outline of the head 63 is not circular.

The exhaust valve 46 comprises an outer valve 65 and an inner valve 66 movably inserted into the outer valve 65.

The outer valve 65 comprises a shaft 68 and a head 71 integrally formed at the distal end of the shaft 68, and a plurality of vent holes 72 is provided in the head 71. The external outline of the head 71 is not circular.

The inner valve 66 comprises a shaft 74 and head 75 integrally formed at the distal end of the shaft 74. The external outline of the head 75 is not circular.

The outer valve 54 of the intake valve 43 is a component in which are formed an inner valve aperture 54*a* formed so that the shaft 57 passes completely through in order to movably insert the inner valve 55, a head accommodation portion 54*b* for accommodating the head 63 of the inner valve 55, and a plurality of vent holes 59 opened so that the top surface 58*a* of the head 58 and the head accommodation portion 54*b* are in communication. Two flanges 71 and 72 are also mounted on the shaft 57 at a distance from each other. The head accommodation portion 54*b* and vent holes 59 described above constitute an inner channel 60 that is opened and closed by the inner valve 55. Reference numeral 54*c* designates a valve face formed at the outer periphery of the head 58 of the outer valve 54 in order to allow close contact with the valve seat 45 (see FIG. 1), and 54*d* is a valve seat formed on the bottom surface of the head 58 of the outer valve 54.

The inner valve 55 is configured so that two flanges 73 and 74 are mounted on the shaft 62 at a distance from each other. Reference numeral 55*a* designates a valve face formed at the outer periphery of the head 63 of the inner valve 55 in order to allow close contact with the valve seat 54*d* of the outer valve 54.

The intake valve operating mechanism 48 has a cam rocker shaft 81 mounted on the cylinder block 21; a cam-side first rocker arm 83 swingably mounted on the cam rocker shaft 81 so as to be driven by a first cam 82 disposed on the camshaft 17; a cylindrical first pushrod 84 swingably connected at one end to the cam-side first rocker arm 83; a valve rocker shaft 86 mounted on the head body 38; a valve first rocker arm 87 which is swingably connected to the other end of the first pushrod 84 and swingably mounted on the valve rocker shaft 86, and whose distal end 87*a* is disposed between the flanges 71 and 72 of the outer valve 54; a cam-side second rocker arm 93 swingably mounted on the cam rocker shaft 81 so as to be driven by a second cam 92 disposed on the camshaft 17; a cylindrical second pushrod 94 swingably connected at the one end of the cam-side second rocker arm 93; a valve second rocker arm 97 which is swingably connected to the other end of the second pushrod 94 and swingably mounted on the valve rocker shaft 86, and whose distal end 97*a* is disposed between the flanges 73 and 74 of the inner valve 55; and a compression coil spring 98 disposed between the flanges 72 and 73.

The first cam 82 and second cam 92 are formed into a shape that satisfies the valve timing characteristics (the details of which are described later) of the outer valve 54 and inner valve 55.

The cam-side first rocker arm 83 is a curved component having a follower 101 that slides against the first cam 82 is mounted at one end, a projection 83*a* which is mounted at the other end and into which an adjustment bolt 102 is threaded, a through hole 83*b* formed in the center portion, and a concave spherical surface 83*c* that constitutes a portion of a spherical surface formed in the through hole 83*b*. The reference numerals 103 and 104 are lock nuts for the adjustment bolt 102.

The first pushrod 84 has a convex spherical surface 84*a* at one end that constitutes a portion of a spherical surface, and the convex spherical surface 84*a* and concave spherical surface 83*c* of the cam-side first rocker arm 83 are slidably fitted together. The concave spherical surface 83*c* and convex spherical surface 84*a* constitute a spherical sliding bearing 106.

The valve first rocker arm 87 has a through hole 87*b* formed in the center area, and also has a concave spherical surface 87*c* that constitutes a portion of a spherical surface formed in the through hole 87*b*.

The concave spherical surface 87*c* of the valve first rocker arm 87 and the convex spherical surface 84*b* of the first pushrod 84 are slidably fitted together. The concave spherical surface 87*c* and convex spherical surface 84*b* constitute a spherical sliding bearing 107.

The cam-side second rocker arm 93 comprises a first arm 93*a* having a follower 111 mounted at the distal end, a second arm 93*c* having a concave spherical surface 93*b* formed at the distal end, and a projection 93*d* extended so as to face the projection 83*a* of the cam-side first rocker arm 83.

The second pushrod 94 has narrow shaft portions 94*a* and 94*b* at each end, and comprises spheroids 94*c* and 94*d* formed at the distal ends of the narrow shaft portions 94*a* and 94*b*, respectively. The spheroid 94*c* and the concave spherical surface 93*b* of the cam-side second rocker arm 93 are slidably fitted together. The concave spherical surface 93*b* and spheroid 94*c* constitute a spherical sliding bearing 113.

The valve second rocker arm 97 has an expanded portion 97*b* formed in the center area, and a concave spherical surface 97*c* that constitutes a portion of a spherical surface formed in the expanded portion 97*b*. The concave spherical surface 97*c* and the spheroid 94*d* of the second pushrod 94 are sidably fitted together. The concave spherical surface 97*c* and the spheroid 94*d* constitute a spherical sliding bearing 114.

The adjustment bolt 102 adjusts the distance between the distal end 102*a* of the adjustment bolt and the projection 93*d* of the cam-side second rocker arm 93, and allows the angle to be adjusted between the projection 93*d* and the distal end 102*a* of the adjustment bolt 102 until the two make contact.

The cam-side second rocker arm 93 is swung clockwise by the second cam 92, the inner valve 55 begins to open by way of the second pushrod 94 and valve second rocker arm 97, and the projection 93*d* subsequently makes contact with the distal end 102*a* of the adjustment bolt 102, whereby the cam-side first rocker arm 83 begins to swing together with the cam-side second rocker arm 93, and the outer valve 54 begins to open by way of the first pushrod 84 and valve first rocker arm 87. The adjustment bolt 102 therefore adjusts the timing for opening the outer valve 54.

The cam-side first rocker arm 83 is swung by the first cam 82 in the counterclockwise direction, the outer valve 54 begins to close by way of the first pushrod 84 and valve first rocker arm 87, and the distal end 102*a* of the adjustment bolt 102 makes contact with the projection 93*d*, whereby the cam-side second rocker arm 93 begins to swing together with the cam-side first rocker arm 83, and the inner valve 55 begins to close by way of the second pushrod 94 and valve second rocker arm 97. The adjustment bolt 102 therefore adjusts the timing for closing the inner valve 55.

Figure 4A:
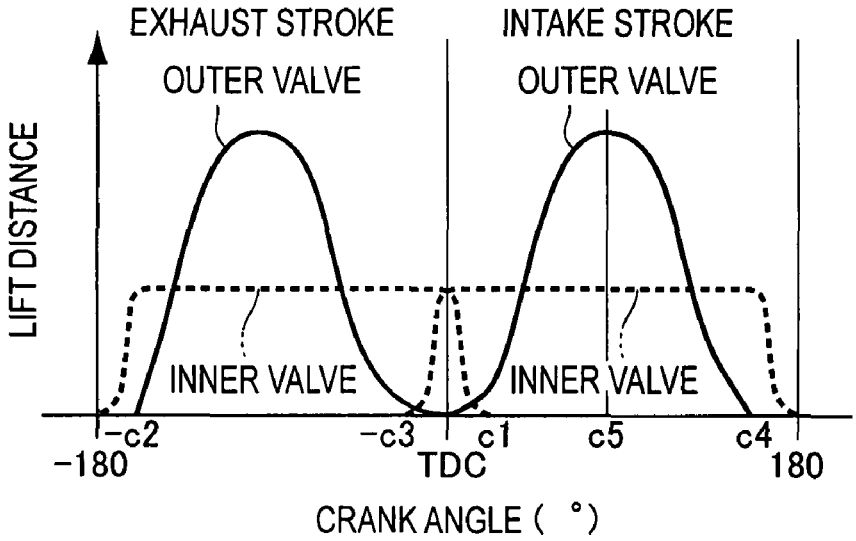
FIGS. 4A and 4B are graphs showing the valve timing characteristics of the intake and exhaust valves of the valve-operating mechanism according to the first embodiment of the present invention, FIG. 4A showing the valve timing characteristics, FIG. 4B showing the valve timing characteristics in which the reference of the lift distance has been modified on the basis of FIG. 4A.

In FIG. 4A, the vertical axis represents the lift distance of the inner and outer valves of the intake and exhaust valves, and the horizontal axis represents the crank angle (units: degrees). The lift distance for the outer valve is measured from the valve seat, and the lift distance for the inner valve is measured from the outer valve.

The inner valve of the exhaust valve opens, for example, at −180° and closes at a crank angle c1.

The outer valve of the exhaust valve opens at a crank angle −c2 and closes at top dead center.

The inner valve of the intake valve opens at a crank angle −c3 and closes at 180°.

The outer valve of the intake valve opens at top dead center and closes at a crank angle c4.

In this manner, the inner and outer valves of the exhaust valve open and close substantially at the same time, and the inner and outer valves of the intake valve open and close at substantially the same time. The outer valves of the intake and exhaust valves do not overlap in the vicinity of top dead center, and the inner valves of the intake and exhaust valves overlap and open only in the vicinity of top dead center.

Figure 4B:
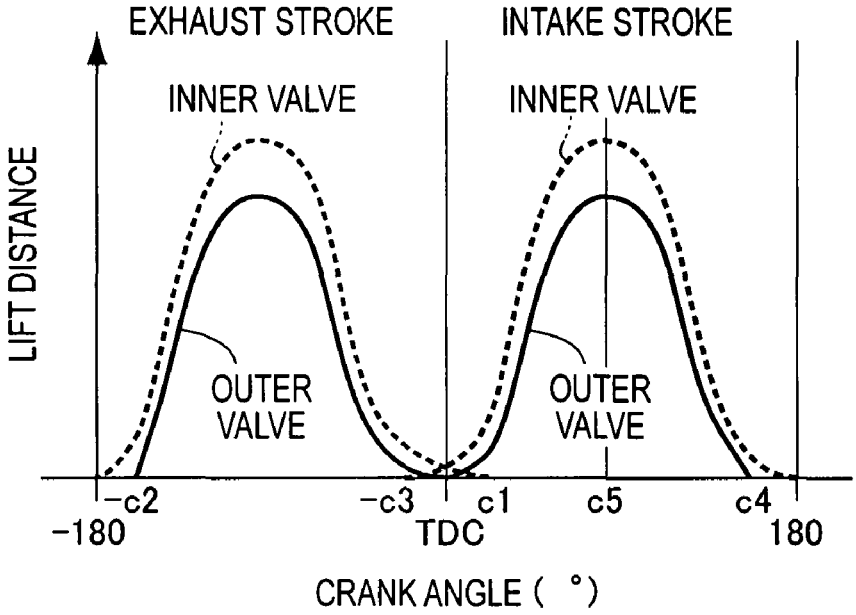

In FIG. 4B, the lift distance of the inner valves of the intake and exhaust valves is converted, based on the graph of FIG. 4A, to the lift distance from the valve seat in the same manner as for the outer valves.

In other words, the inner valves of the intake and exhaust valves have a lift distance that is greater than that of the outer valves of the intake and exhaust valves.

Figure 5B:
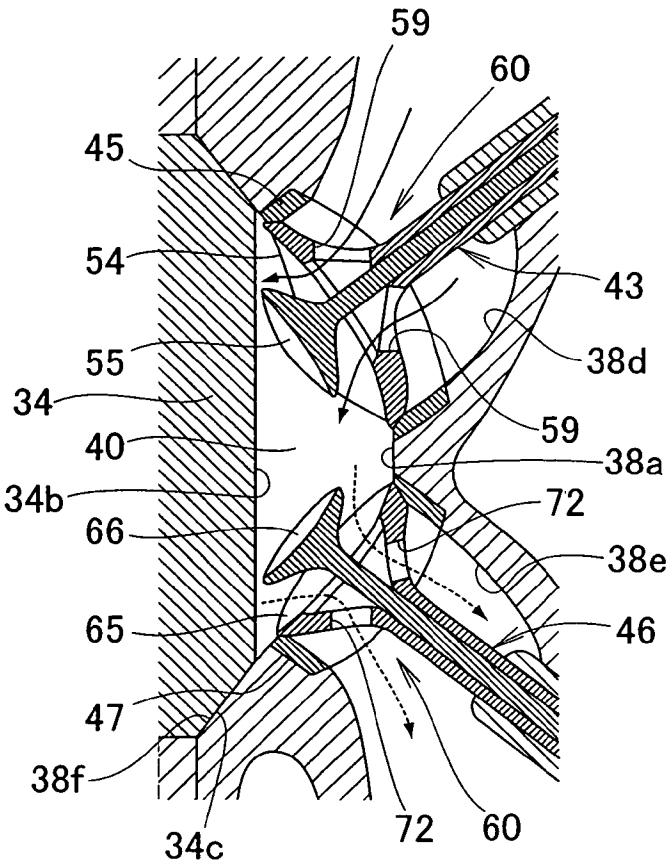
FIGS. 5A and 5B are schematic views illustrating the valve timing characteristics of the intake and exhaust valves of the valve-operating mechanism according to the first embodiment of the present invention, FIG. 5A showing the opening and closing states of the intake valve at the crank angle c5 in FIG. 4A, FIG. 5B showing the opening and closing states of the intake and exhaust valves at top dead center in the graphs of FIGS. 4A and 4B.
Figure 5A:
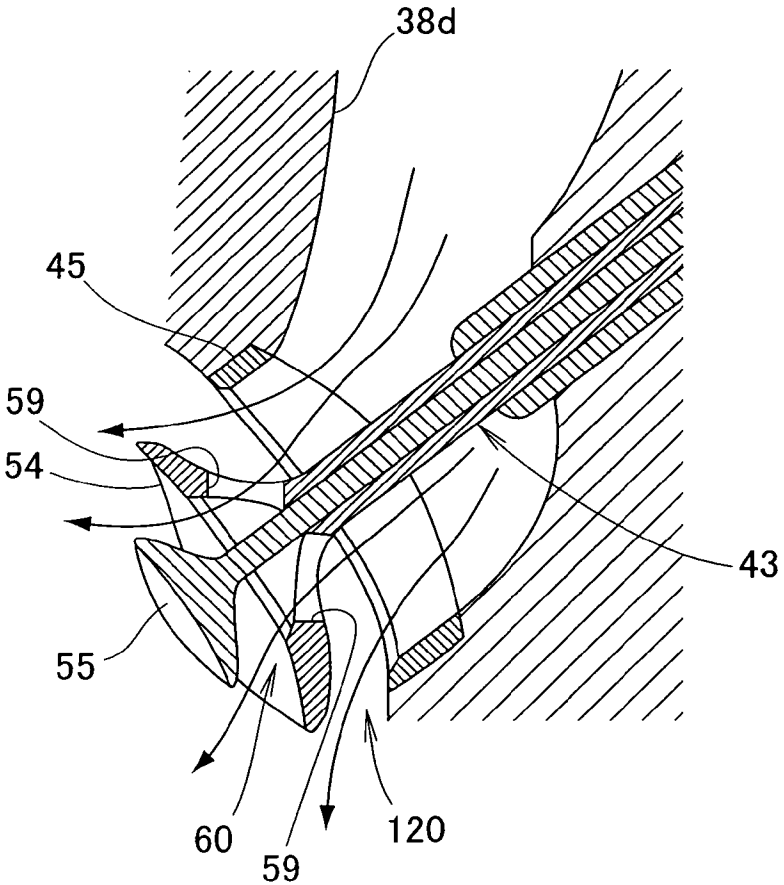

FIG. 5A is a view showing the opening and closing states of the intake valve 43 at the crank angle c5 in the graphs shown in FIGS. 4A and 4B. The view shows the state in which the outer valve 54 has lifted from the valve seat 45, the inner valve 55 has lifted from the outer valve 54, and an outer channel 120 (a channel between the valve seat 45 and outer valve 54) and the inner channel 60 have both been opened.

The effective aperture surface area of the intake valve 43 can thereby be expanded, and the intake amount and engine output can be increased.

The exhaust valve 46 (see FIG. 1) is also configured so that the outer valve 65 (see FIG. 1) and inner valve 66 (see FIG. 1) open simultaneously, whereby the exhaust resistance can be reduced.

FIG. 5B is a view showing the opening and closing states of the intake valve 43 and exhaust valve 46 at top dead center in the graphs of FIGS. 4A and 4B. The outer valve 54 of the intake valve 43 is in contact with the valve seat 45, the inner valve 55 has lifted from the outer valve 54, and the inner channel 60 is open. Similarly, the outer valve 65 of the exhaust valve 46 is in contact with the valve seat 47, the inner valve 66 has lifted from the outer valve 65, and the inner channel 60 is open.

The reference numeral 34*c* in the view designates an annular tapered portion formed about the periphery of the top surface 34*b* of the piston 34 so that squish can be generated when the top surface approaches the concave tapered wall 38*f* formed about the periphery of the combustion chamber wall 38*a*.

In this manner, an air-fuel mixture passes from the intake port 38*d*, passes through the inner channel 60, and flows into the combustion chamber 40, as indicated by the solid line arrow, and the residual gas left in the combustion chamber 40 after combustion passes through the inner channel 60 and flows out to the exhaust port 38*e*, as indicated by the broken line arrow.

Thus, only the inner valves 55 and 66 open at top dead center at the completion of the exhaust stroke, whereby the lift distance of the inner valves 55 and 66 can be extended without causing interference with the top surface 34*b* of the piston 34, the amount of inflowing fuel-air mixture and the amount of exhausted residual gas can be increased, and scavenging can be more reliably carried out. Since a valve recess does not need to be provided to the top surface 34*b* of the piston 34, the surface area of the tapered portion 34*c*, which forms the squish area of the piston 34, can be increased and a more effective squish can be produced.

As shown in FIGS. 1 to 5, the present invention is a valve-operating mechanism for an internal combustion engine 10 in which an intake valve 43 and an exhaust valve 46 for respectively opening and closing an air intake port 38*d* and an exhaust port 38*e* that lead to a combustion chamber 40 are disposed in a cylinder head 22, wherein the intake valve 43 is a dual valve having an outer valve 54 in which an inner valve aperture 54*a* that passes through the valve in the axial direction is formed, and also having an inner valve 55 movably inserted in the inner valve aperture 54*a*; the exhaust valve 46 is a dual valve having an a outer valve 65 in which an inner valve aperture 54*a* that passes through the valve in the axial direction is formed, and also having an inner valve 66 movably inserted in the inner valve aperture 54*a*; an inner channel 60 that allows communication between the combustion chamber 40 and the intake and exhaust ports 38*d* and 38*e* and that is opened and closed by the inner valves 55 and 66 is formed in the outer valves 54 and 65; a first cam 82 and second cam 92 as valve control members that control the opening and closing of the outer valves 54 and 65 and the inner valves 55 and 66 are provided; and the first cam 82 and second cam 92, at least during scavenging, simultaneously close the outer valves 54 and 65 of the intake and exhaust valves 43 and 46, producing a non-overlapping state, and simultaneously open the inner valves 55 and 66 of the intake and exhaust valves 43 and 46, producing an overlapping state.

Scavenging can thereby be more reliably carried out at top dead center in the high-speed region, the valve recess in the top surface 34*b* of the piston 34 can be eliminated, the tapered portion 34*c* acting as squish area can be increased, and the engine performance and combustion efficiency can be improved.

The effects of the intake valve operating mechanism 48 mentioned above are described with respect to FIGS. 6 to 8 below. The first cam 82, second cam 92, intake valve 43, and intake valve operating mechanism 48 are depicted in a simplified manner.

Figure 6B:
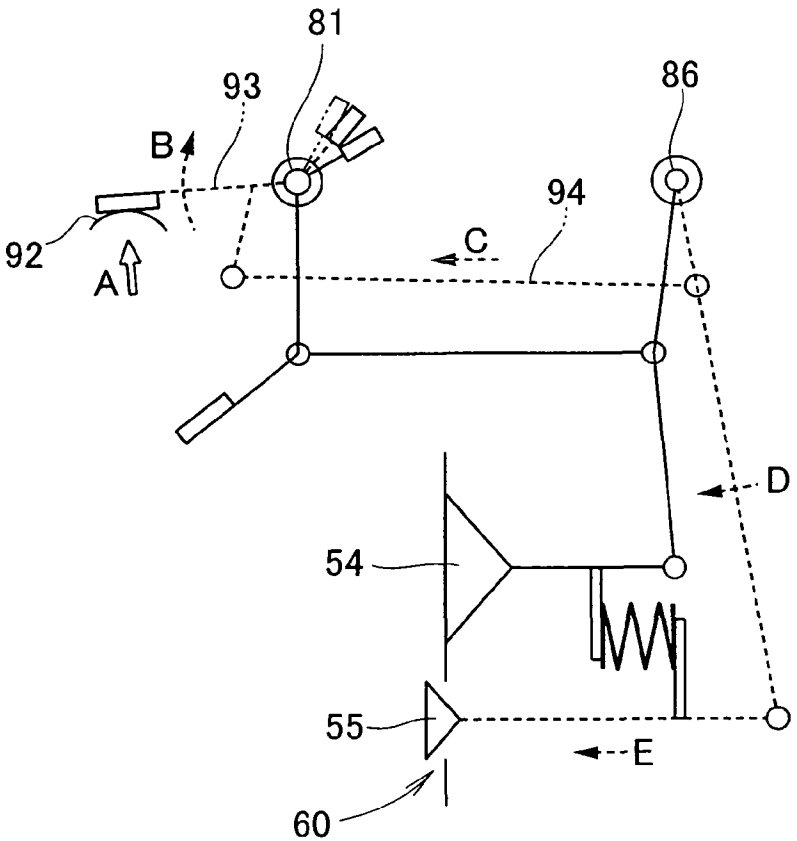
FIGS. 6A and 6B are diagrammatical views illustrating an operation of the intake-side valve operating mechanism according to the first embodiment of the present invention, FIG. 6A showing the inner valve and the outer valve of the intake valve being closed, and FIG. 6B showing the operation of opening of the inner valve.
Figure 6A:
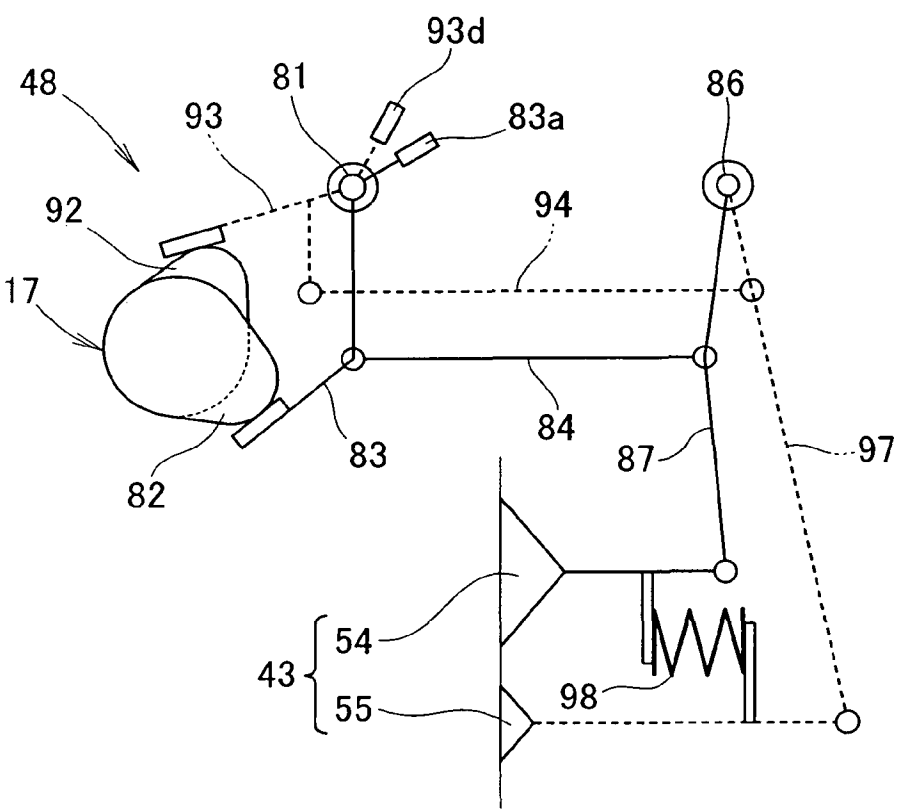

FIG. 6A shows a configuration comprising a camshaft 17, a cam-side first rocker arm 83 driven by a first cam 82 of the camshaft 17, a first pushrod 84 connected at one end to the cam-side first rocker arm 83, a valve first rocker arm 87 connected to the other end of the first pushrod 84, a cam-side second rocker arm 93 driven by a second cam 92 of the camshaft 17, a second pushrod 94 connected at one end to the cam-side second rocker arm 93, a valve second rocker arm 97 connected to the other end of the second pushrod 94, and a compression coil spring 98 disposed between an outer valve 54 and an inner valve 55. The outer valve 54 and inner valve 55 of the intake valve 43 are also shown to be closed.

When there is input from the second cam 92 to the cam-side second rocker arm 93, as shown by arrow A in FIG. 6B, the cam-side second rocker arm 93 swings about the second rocker shaft 81, as shown by arrow B.

As a result, the second pushrod 94 moves in the manner indicated by arrow C, the valve second rocker arm 97 swings about the valve rocker shaft 86 in the manner indicated by arrow D, and the inner valve 55 moves in the manner indicated by arrow E and opens the inner channel 60.

Figure 7B:
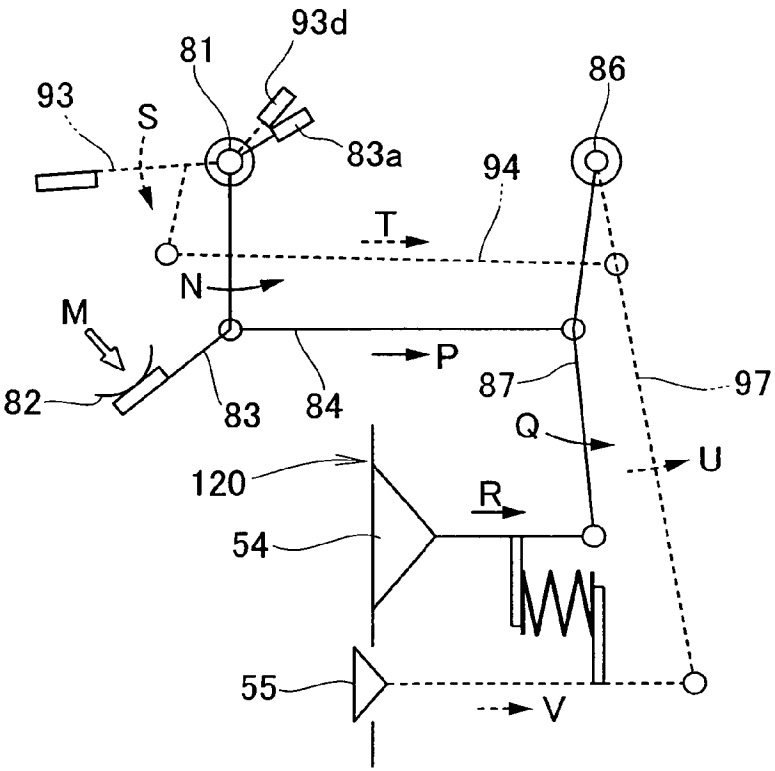
FIG. 7A and 7B are diagrammatical views illustrating an operation of the intake-side valve operating mechanism according to the first embodiment of the present invention, FIG. 7A showing an operation that occurs until the outer and inner valves open, FIG. 7B showing the operation of closing of the outer valve.
Figure 7A:
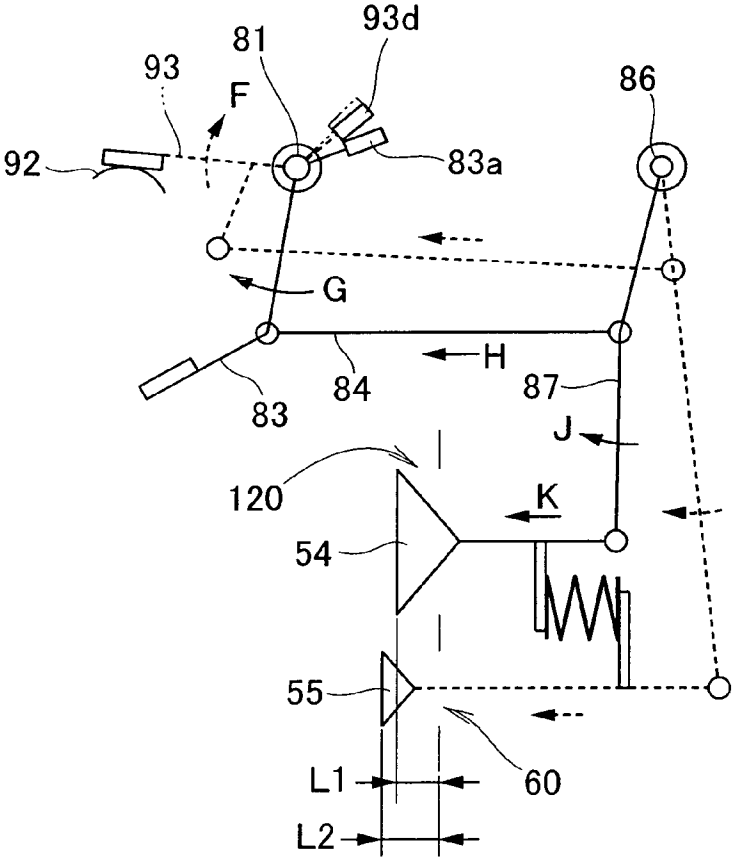

In FIG. 7A, When the cam-side second rocker arm 93 swings in the manner indicated by arrow F by further input from the second cam 92, the projection 93*d* of the cam-side second rocker arm 93 pushes the projection 83*a* of the cam-side first rocker arm 83 via an adjustment bolt (not shown), and the cam-side second rocker arm 93 therefore swings in the manner indicated by arrow G.

As a result, the first pushrod 84 moves in the manner indicated by arrow H, the valve first rocker arm 87 swings about the valve rocker shaft 86 in the manner indicated by arrow J, and the outer valve 54 moves in the manner indicated by arrow K and opens the outer channel 120. The inner valve 55 opens further as the outer valve 54 opens.

The lift distances at this point are L1 and L2, respectively, as measured from the valve sheet of the outer valve 54 and inner valve 55.

When there is input from the first cam 82 to the cam-side first rocker arm 83, as shown by arrow M in FIG. 7B, the cam-side first rocker arm 83 swings about the first rocker shaft 81, as shown by arrow N.

As a result, the first pushrod 84 moves in the manner indicated by arrow P, the valve second rocker arm 87 swings about the valve rocker shaft 86 in the manner indicated by arrow Q, and the outer valve 54 moves in the manner indicated by arrow R and closes the outer channel 120.

The projection 83*a* pushes the projection 93*d* and causes the cam-side second rocker arm 93 to swing in the manner indicated by arrow S in the period in which the cam-side first rocker arm 83 is swinging. As a result, the second pushrod 94 moves in the manner indicated by arrow T, the valve second rocker arm 97 swings about the valve rocker shaft 86 in the manner indicated by arrow U, and the inner valve 55 moves in the manner indicated by arrow V.

Figure 8:
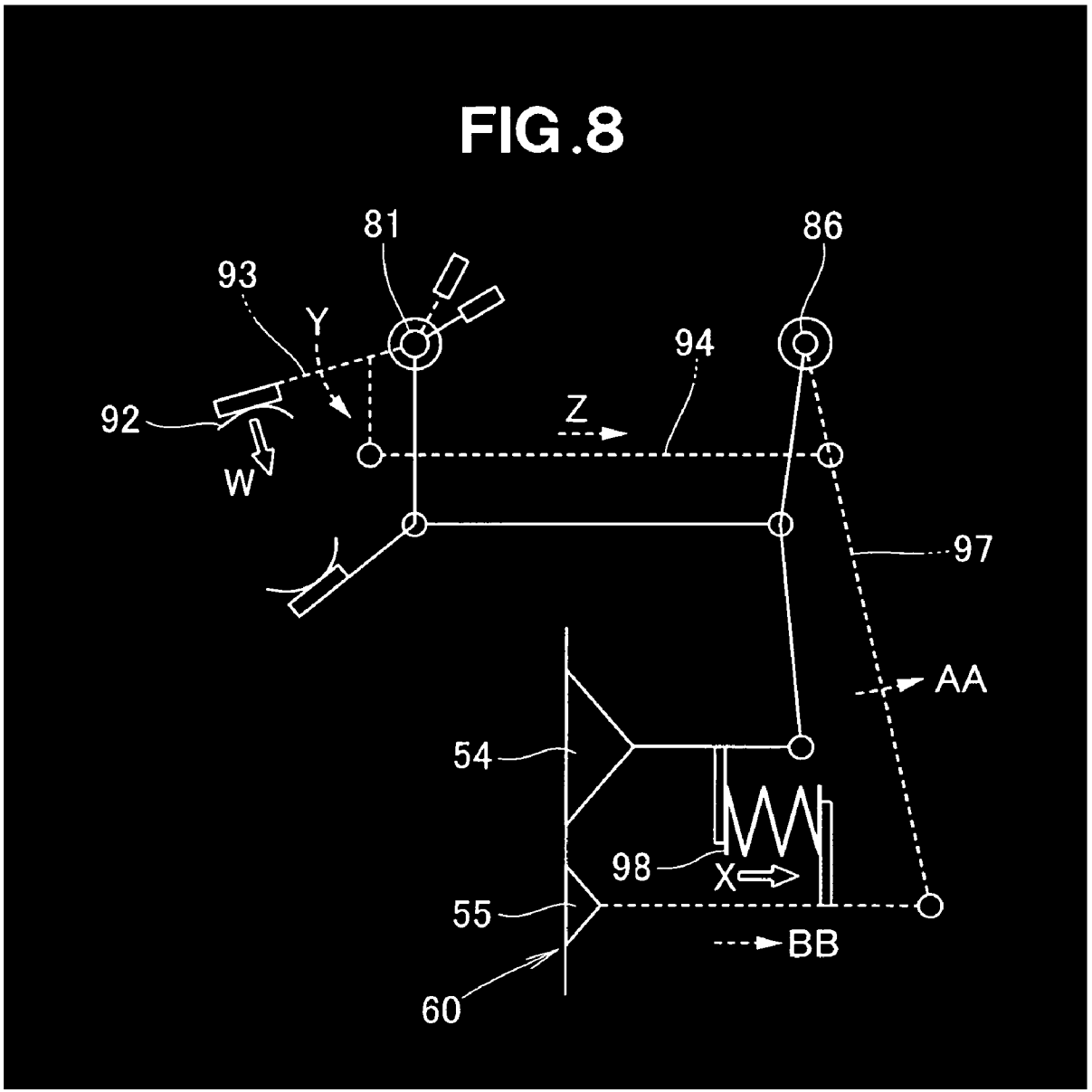
FIG. 8 is a diagrammatical view showing an operation of the intake-side valve operating mechanism according to the first embodiment of the present invention.

As shown in FIG. 8, when the second cam 92 gradually retracts in the manner indicated by arrow W with respect to the cam-side second rocker arm 93, the cam-side second rocker arm 93 swings in the manner indicated by arrow Y due to the elastic force (operating in the direction indicated by the white arrow X) of the compression coil spring 98, the second pushrod 94 moves in the manner indicated by arrow Z, the valve second rocker arm 97 swings in the manner indicated by arrow AA, and the inner valve 55 moves in the manner indicated by arrow BB and closes the inner channel 60.

As shown in FIGS. 6 to 8 described above, rotation of the camshaft 17 first causes the inner valve 55 to be opened by the second cam 92, and then causes the outer valve 54 to be opened. The outer valve 54 is then closed by the first cam 82, and the inner valve 55 is subsequently closed by the first cam 82 and compression coil spring 98.

As shown in FIGS. 1 to 3, and 5, the present invention provides a valve-operating mechanism for an internal combustion engine 10 in which an intake valve 43 and an exhaust valve 46 for respectively opening and closing an air intake port 38*d* and an exhaust port 38*e* that lead to a combustion chamber 40 are disposed in a cylinder head 22, wherein the intake valve 43 is a dual valve having an outer valve 54 in which an inner valve aperture 54*a* that passes through the valve in the axial direction is formed, and also having an inner valve 55 movably inserted in the inner valve aperture 54*a*; the exhaust valve 46 is a dual valve having an a outer valve 65 in which an inner valve aperture 54*a* that passes through the valve in the axial direction is formed, and also having an inner valve 66 movably inserted in the inner valve aperture 54*a*; an inner channel 60 that allows communication between the combustion chamber 40 and the intake and exhaust ports 38*d* and 38*e* and that is opened and closed by the inner valves 55 and 66 is formed on the outer valves 54 and 65; a first cam 82 and second cam 92 as valve control members that control the opening and closing of the outer valves 54 and 65 and the inner valves 55 and 66 are provided; the first cam 82 and second cam 92 respectively open the outer valve 65 and the inner valve 66 of the exhaust valve 46 in the exhaust stroke, and respectively open the outer valve 54 and inner valve 55 of the intake valve 43 in the intake stroke.

The effective aperture surface area of the intake and exhaust valves can be expanded, the intake amount can be increased, and engine output can be improved.

Figure 9:
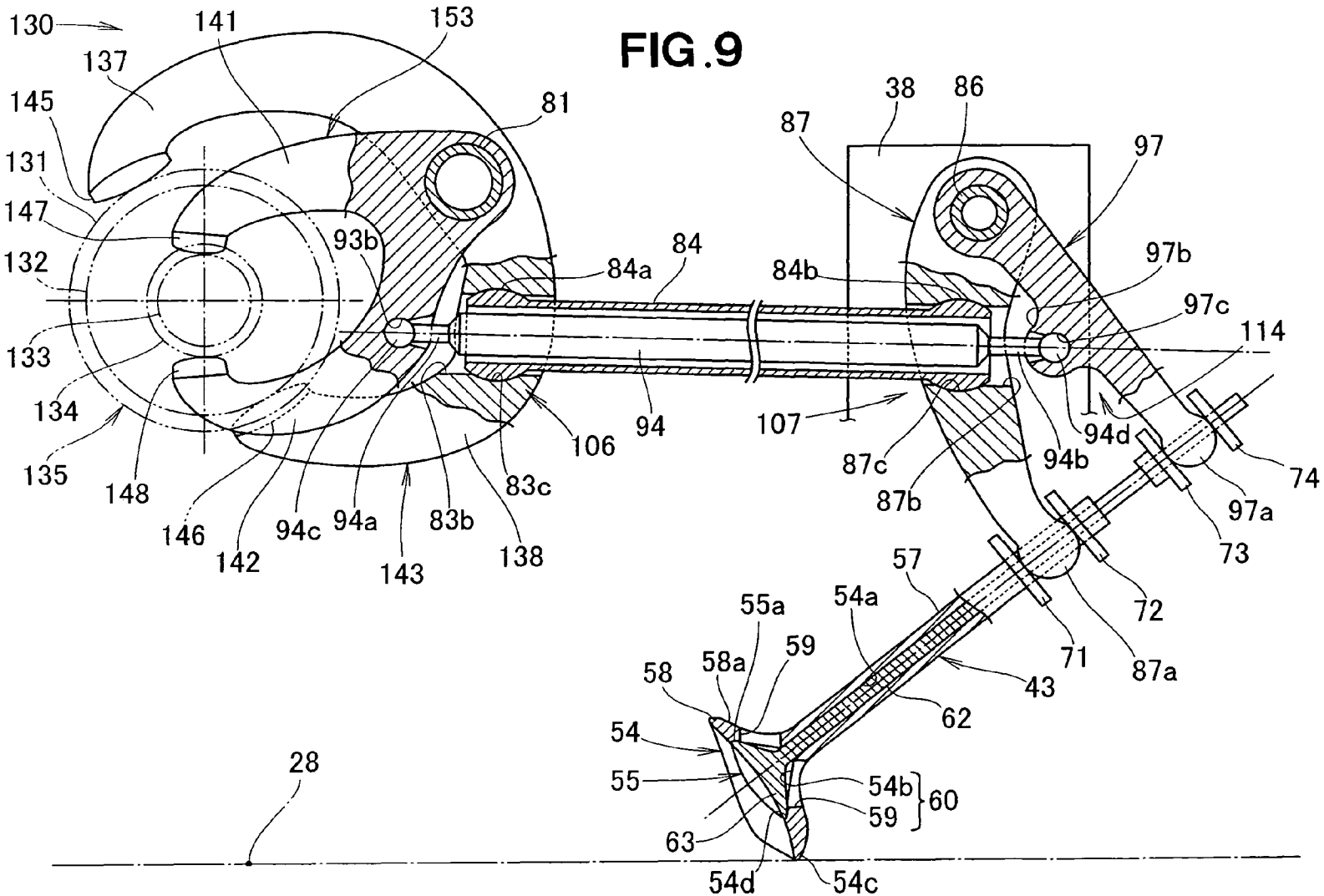
FIG. 9 is a cross-sectional view illustrating an intake-side valve-operating mechanism and associated intake valve according to a second embodiment of the present.

As shown in FIG. 9, an intake valve operating mechanism 130 is a mechanism that forcibly opens and closes an outer valve 54 and an inner valve 55. The mechanism comprises a cam rocker shaft 81; a cam-side first rocker arm 143 swingably mounted on the cam rocker shaft 81 and provided with a first valve-opening arm 137 that makes contact with a first cam 131, and with a first valve-closing arm 138 that makes contact with a second cam 132, which are components of the camshaft 135 comprising the first cam 131, the second cam 132, a third cam 133, and a fourth cam 134; a cylindrical first pushrod 84 swingably connected at one end to the cam-side first rocker arm 143; a valve rocker shaft 86; a valve first rocker arm 87; a cam-side second rocker arm 153 swingably mounted on the cam rocker shaft 81 and provided with a second valve-opening arm 141 that makes contact with the third cam 133, and with a second valve-closing arm 142 that makes contact with the fourth cam 134; a rod-shaped second pushrod 94 swingably connected at one end to the cam-side second rocker arm 153; and a valve second rocker arm 97.

The cam-side first rocker arm 143 is a component that is curved in substantially the form of the letter C. The component has a follower 145 that slides against the first cam 131 at the distal end of the first valve-opening arm 137, and a follower 146 that slides with the second cam 132 at the distal end of the first valve-closing arm 138. A through hole 83*b* is formed in an intermediate portion of the first valve-closing arm 138, and a concave spherical surface 83*c* constituting a portion of a spherical surface is formed in the through hole 83*b*.

Figure 10:
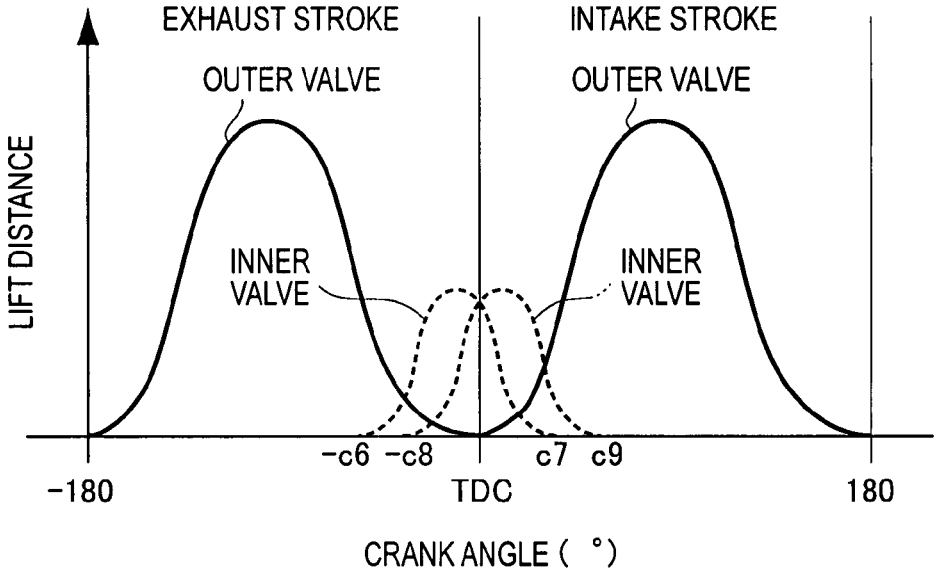
FIG. 10 is a graph showing valve timing characteristics of the intake and exhaust valves of the valve-operating mechanism according to the second embodiment of the present invention.

The first cam 131 through fourth cam 134 are formed into a shape that satisfies the valve timing characteristics of the outer valve 54 and inner valve 55 shown in FIG. 10.

The cam-side second rocker arm 153 is a component that is curved in substantially the form of the letter C. The component has a follower 147 that slides against the third cam 133 at the distal end of the second valve-opening arm 141, and a follower 148 that slides against the fourth cam 134 at the distal end of the second valve-closing arm 142. A concave spherical surface 93*b* is formed in an intermediate portion of the second valve-closing arm 142.

In FIG. 10, the vertical axis represents the lift distance of the inner and outer valves of the intake and exhaust valves, and the horizontal axis represents the crank angle (units: degrees). The lift distance for the outer valve is measured from the valve seat, and the lift distance for the inner valve is measured from the outer valve.

The outer valve of the exhaust valve opens, for example, at −180° and closes at top dead center.

The inner valve of the exhaust valve opens at a crank angle −c6 and closes at a crank angle c7.

The outer valve of the intake valve opens at top dead center and closes at 180°.

The inner valve of the intake valve opens at a crank angle −c8 and closes at a crank angle c9.

In this manner, the outer valves of the intake and exhaust valves do not overlap in the vicinity of top dead center, and the inner valves of the intake and exhaust valves overlap and open only in the vicinity of top dead center.

The open and closed states of the intake valve 43 and exhaust valve 46 at top dead center in the valve timing characteristics are the same as those shown in FIG. 5B.

Figure 11B:
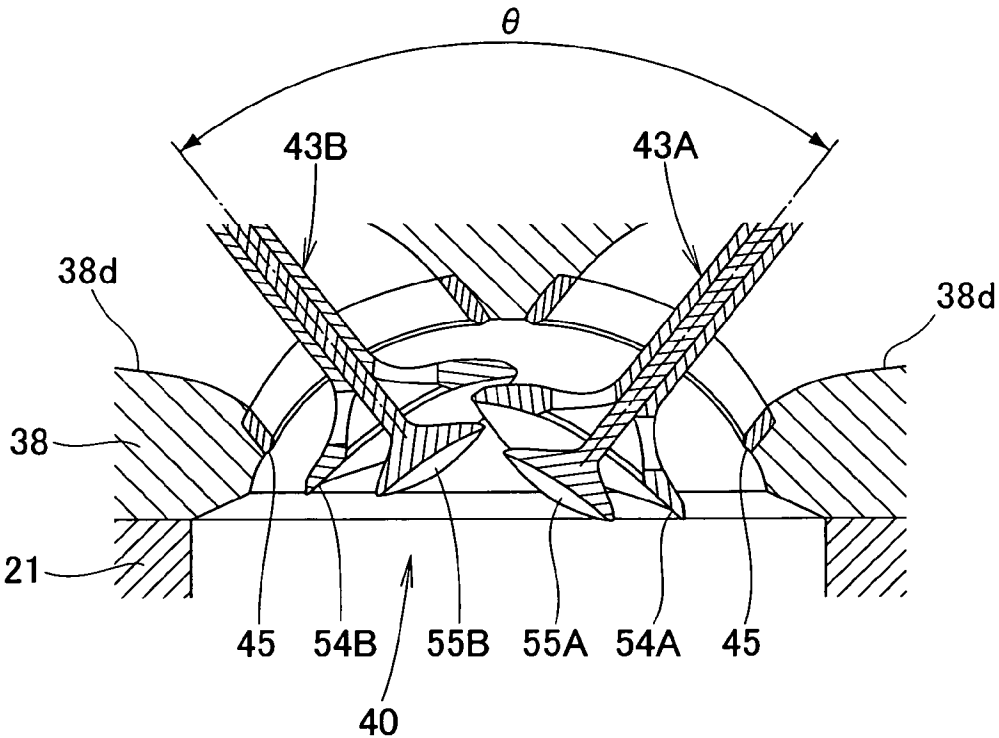
FIG. 11B illustrates opening and closing actions of a pair of intake valves provided with an outer valve at the crank angle c12 of FIG. 11A.
Figure 11A:
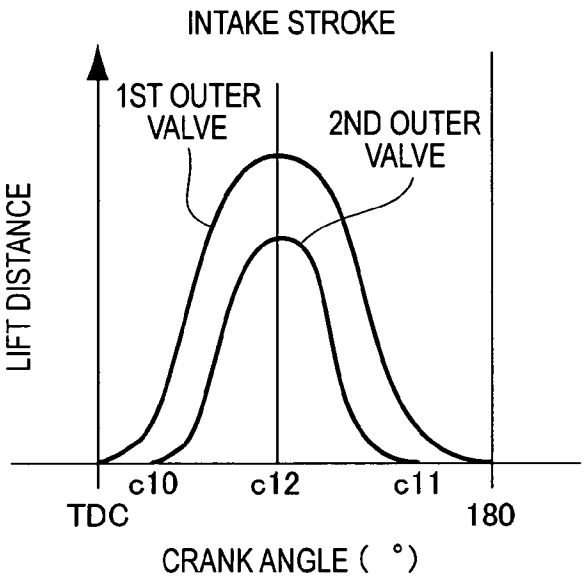

In FIG. 11A, the vertical axis represents the lift distance of the outer valves of the intake valves, and the horizontal axis represents the crank angle (units: degrees). The lift distance is measured from the valve seat One of the outer valves (i.e., the first outer valve) of the pair of outer valves opens, for example, at top dead center and closes at −180°.

The other of the outer valves (i.e., the second outer valve) of the pair of outer valves opens at a crank angle c10 and closes at a crank angle c11.

In this manner, the first outer valve opens earlier and closes later in relation to the second outer valve.

The two intake valves are first intake valve 43A and second intake valve 43B (the first intake valve 43A and second intake valve 43B have the same structure as the intake valve 43), as shown in FIG. 11B. The first intake valve 43A is composed of a first outer valve 54A and a first inner valve 55A. The second intake valve 43B is composed of a second outer valve 54B and a second inner valve 55B. In the view, θ is the valve-included angle between the first intake valve 43A and the second intake valve 43B.

The first outer valve 54A of the first intake valve 43A opens earlier than the second outer valve 54B of the second intake valve 43B, and the lift distance is greater. In this manner, even if the external outline of first outer valve 54A and second outer valve 54B is large, the first outer valve 54A and second outer valve 54B are overlapped so as to avoid interference, and the effective aperture surface areas of the first outer valve 54A and outer valve 54B can be increased by making the valve timing between the first outer valve 54A and outer valve 54B to be different. The effective aperture surface area can be further increased by opening the first inner valve 55A and second inner valve 55B.

Since the intake valves 43A and 43B do not interfere even if the lift distance is extended, the valve-included angle θ can be widened, the external outlines of the head portions of the intake valves 43A and 43B, i.e., the outer valves 54A and 54B and the inner valves 55A and 55B, can be increased, and the effective aperture surface area can be expanded.

As shown in FIGS. 1, 2, and 9, the present invention provides a valve-operating mechanism for an internal combustion engine 10 in which a plurality of intake valves 43A and 43B and an exhaust valve 46 are radially disposed with respect to the cylinder axis 28, wherein the mechanism comprises a first cam 82 and a second cam 92 as valve control members for preventing interference between the plurality of intake valves 43A and 43B by controlling the opening and closing of the plurality of intake valves 43A and 43B, i.e., the outer valves 54A and 54B and the inner valves 55A and 55B, with the aid of different valve timings and different lift distances, respectively.

Interference between the intake valves 43A and 43B can thereby be prevented, and the valve lift distance can be increased. Also, the valve-included angle θ can be widened, and the external outline of the head portions can be increased. Because of the above, the aperture surface area of the intake valves 43A and 43B can be expanded, the intake amount can be increased, and the output of an internal combustion engine can be improved.

The valve-included angle θ can furthermore be widened, whereby the distance between the combustion chamber wall and the intake valves 43A and 43B can be increased when the intake valves 43A and 43B have opened, the effective aperture surface area of the intake valves 43A and 43B can be expanded, and a further increase in the intake amount can be assured.

At least one valve selected from the intake valve 43 and the exhaust valve 46 features head portions 58, 63, 71, and 75 that are not circular.

The aperture surface area can thereby be increased and a further increase in the intake amount can be assured.

As shown in FIGS. 3, and 6 to 8, the present invention provides an intake valve-operating mechanism 48 for an internal combustion engine 10 (see FIG. 1) in which rotation of a camshaft 17 is converted to opening and closing action of intake valve 43 via pushrods 84 and 94 and rocker arms 87 and 97, wherein the intake valve 43 is a dual valve having an outer valve 54 in which an inner valve aperture 54*a* that passes through the valve in the axial direction is formed, and also having an inner valve 55 movably inserted in the inner valve aperture 54*a*; an inner channel 60 that allows communication between the combustion chamber 40 and the intake and exhaust ports 38*d* and 38*e* and that is opened and closed by the inner valve 55 is formed in the outer valve 54; the intake valve operating mechanism 48 has a cam first rocker shaft 83 as an outer valve first rocker arm that makes contact with a first cam 82 as an outer valve cam disposed on the camshaft 17 in order to open and close the outer valve 54 and that is swingably supported by a cam rocker shaft 81 as a first rocker shaft, also has a first pushrod 84 as an outer valve pushrod in which one end is connected to the cam-side first rocker arm 83, also has a valve first rocker arm 87 as an outer valve second rocker arm connected to the other end of the first pushrod 84, swingably supported by a valve rocker shaft 86 as a second rocker shaft, and connected to the outer valve 54, also has a cam-side second rocker arm 93 as an inner valve first rocker arm that makes contact with a second cam 92 as an inner valve cam disposed on the camshaft 17 in order to open and close the inner valve 55 and that is swingably supported by a cam rocker shaft 81, also has a second pushrod 94 as an inner valve pushrod in which one end is connected to the cam-side second rocker arm 93, and also has a valve second rocker arm 97 as an inner valve second rocker arm connected to the other end of the second pushrod 94, swingably supported by the valve rocker shaft 86, and connected to the inner valve 55; wherein projections 83*a* and 93*d* as drive arms are formed on the cam-side first rocker arm 83 and the cam-side second rocker arm 93, respectively, so as to push and drive one of the rocker arms when the other rocker arm is driven by first cam 82 or the second cam 92; a pushrod selected from the first pushrod 84 and the second pushrod 94 is cylindrically formed; the other pushrod selected from the first pushrod 84 and the second pushrod 94 is disposed inside the cylindrical pushrod 84, whereby the two pushrods 84 and 94 are substantially coaxially disposed; the outer valve 54 is driven via the projections 83*a* and 93*d* when the inner valve 55 is opened and closed; and the inner valve 55 is driven via the projections 83*a* and 94*d* when the outer valve 54 is opened and closed.

Both the outer valve 54 and inner valve 55 can thereby be simultaneously opened, the intake amount can be increased, and the output of an internal combustion engine can be improved.

The present invention features a compression coil spring 98 as a spring for forcibly closing the inner valve 55 against the outer valve 54, disposed between the outer valve 54 and the inner valve 55.

The inner valve 55 can thereby be reliably closed by the compression coil spring 98 against the outer valve 54, and the sealing characteristics can be assured.

Figure 3:
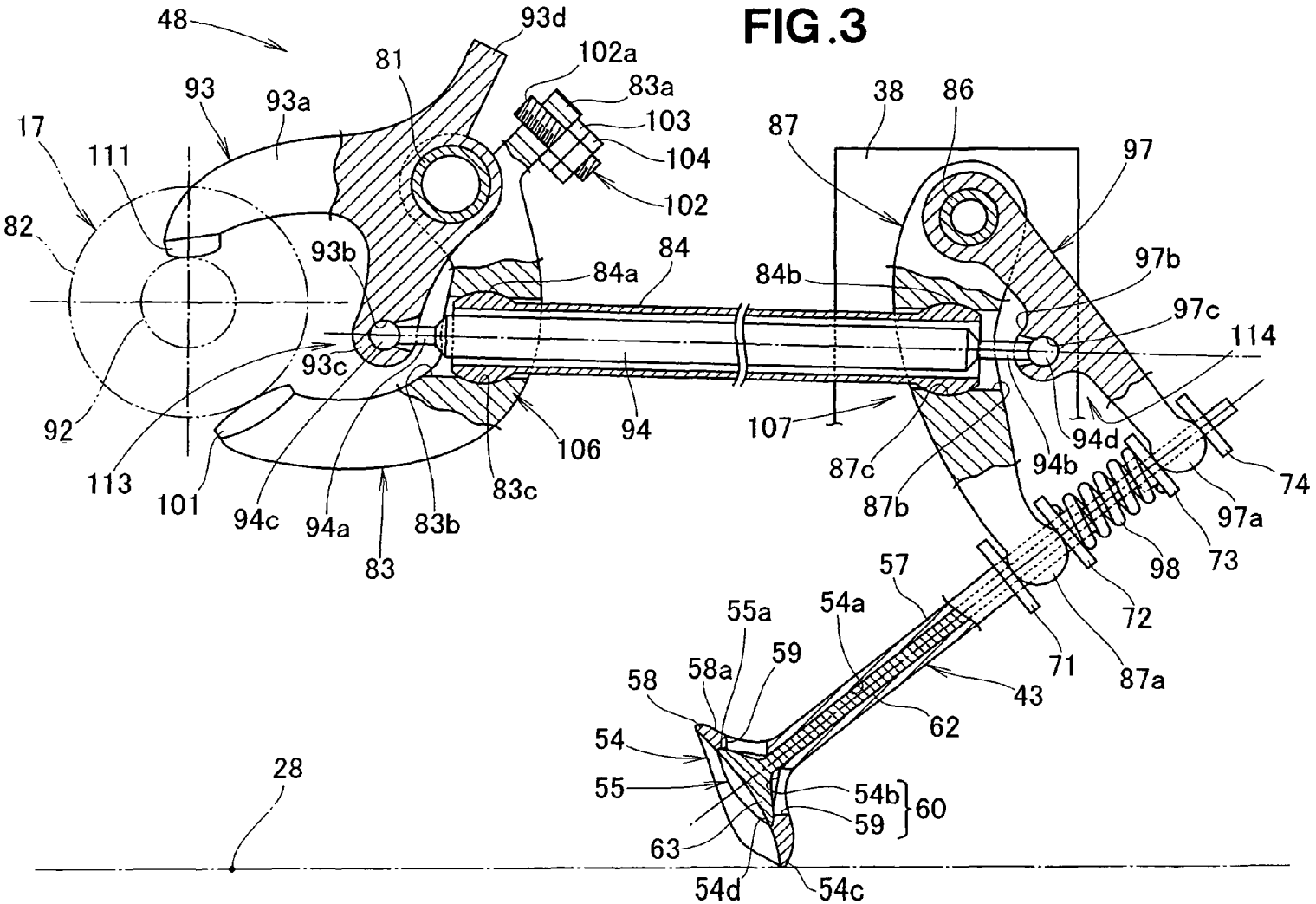
FIG. 3 is a cross-sectional view showing an intake-side valve-operating mechanism and associated intake valve according to the first embodiment of the present invention.
Figure 12:
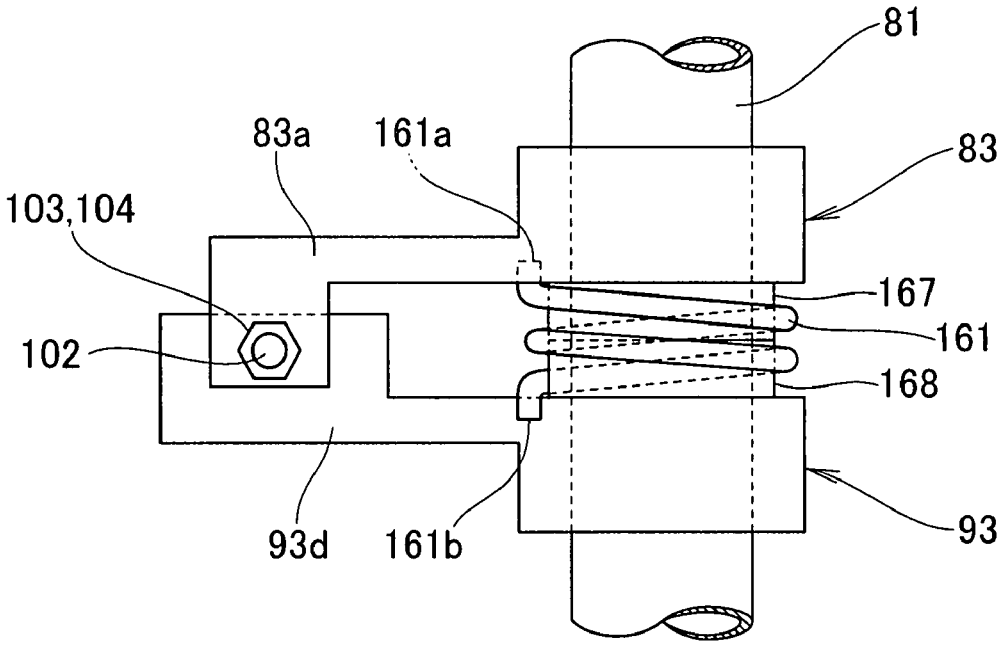
FIG. 12 is a top plan view showing the mechanism for generating elastic force between an inner valve and an outer valve of a valve-operating mechanism according to a fourth embodiment of the present invention.

As shown in FIG. 12, a twisted coil spring 161 is disposed between the cam-side first rocker arm 83 and cam-side second rocker arm 93 in place of the compression coil spring 98 shown in FIG. 3.

Specifically, the cam-side first rocker arm 83 and cam-side second rocker arm 93 are swingably mounted on the cam rocker shaft 81 so that a small-diameter portion 167 disposed at one end of the cam-side first rocker arm 83 and a small-diameter portion 168 disposed at one end of the cam-side second rocker arm 93 are adjacent to each other, the twisted coil spring 161 is fitted onto the small-diameter portions 167 and 168, a bent portion 161*a* disposed at one end of the twisted coil spring 161 is set on the projection 83*a*, and a bent portion 161*b* disposed at the other end of the twisted coil spring 161 is set on the projection 93*d*. The projections 83*a* and 93*d* are thereby urged by the crankshaft 161 so as to separate from each other.

Figure 13:
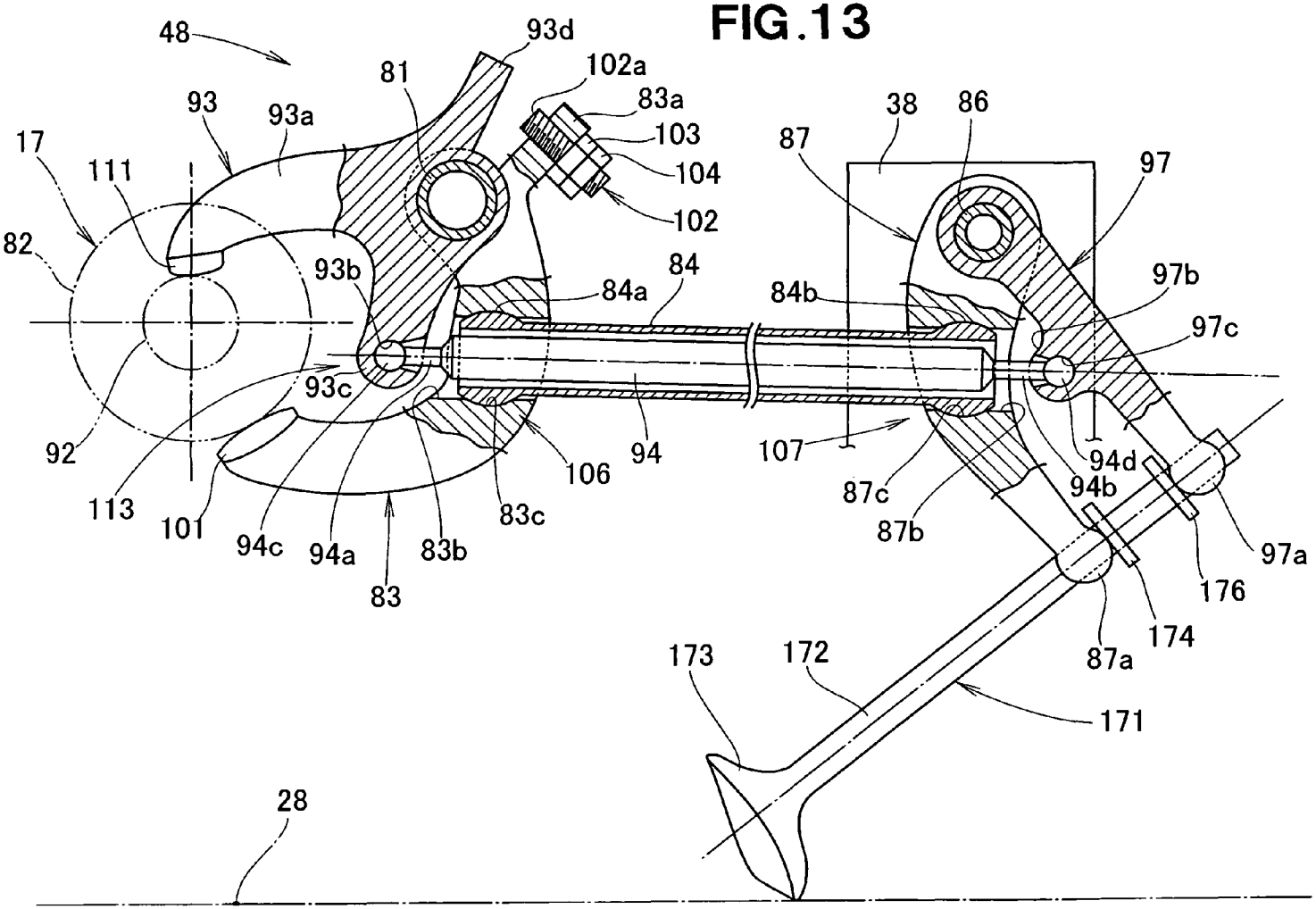
FIG. 13 is a cross-sectional view showing an intake-side valve-operating mechanism and associated intake valve according to a separate embodiment of the present invention.

Reference is made next to FIG. 13 showing an intake valve 171 which is a single valve opened and closed by an intake valve operating mechanism 48.

The intake valve 171 comprises a shaft 172, a non-circular head 173 integrally formed at one end of the shaft 172, and two flanges 174 and 176 mounted on the shaft 172. The two sides of the flanges 174 and 176 are sandwiched between a distal end 87*a* of the valve first rocker arm 87 and a distal end 97*a* of the valve second rocker arm 97.

The exhaust valve (not shown), which forms a pair with the intake valve 171 described above, is a single valve, and the exhaust valve described above can be opened and closed by the exhaust valve operating mechanism (not shown).

As shown in FIG. 10 described above, the present invention provides an intake valve-operating mechanism 48 for an internal combustion engine 10 (see FIG. 1) in which rotation of a camshaft 17 is converted to opening and closing action of an intake valve 171 via pushrods 84 and 94 and rocker arms 87 and 97, the intake valve-operating mechanism 48 comprising a second pushrod 94 as a valve-opening pushrod driven by a second cam 92 as a valve-opening cam of the camshaft 17; a valve second rocker arm 97 as a valve-opening rocker arm connected to the other end of the second pushrod 94, swingably supported by a valve rocker shaft 86, and connected to the intake valve 171; a first pushrod 84 as a valve-closing pushrod driven by a first cam 82 as a valve-closing cam of the camshaft 17; and a valve first rocker arm 87 as a valve-closing rocker arm connected to the other end of the first pushrod 84, swingably supported by the valve rocker shaft 86, and connected to the intake valve 171; wherein a pushrod selected from the second pushrod 94 and first pushrod 84 is cylindrically formed, the other pushrod selected from the second pushrod 94 and first pushrod 84 is disposed inside the cylindrical pushrod 84, whereby the two pushrods 84 and 94 are substantially coaxially disposed, and the intake valve 171 is forcibly opened and closed.

A valve spring is thereby no longer required and an internal combustion engine 10 can operate at a higher speed. Components do not need to be newly installed to allow an internal combustion engine 10 to operate at a higher speed, and the space for accommodating pushrods 84 and 94 can be reduced by disposing the two pushrods 84 and 94 in a substantially coaxial manner. Therefore, an internal combustion engine can be reduced in size and made more compact, and the structure can be simplified.

In the present invention, the intake valves 43A and 43B are dual valves, as shown in FIGS. 9A and 9B, and the valve timing and valve lift distance of these intake valves 43A and 43B are different. However, the present invention is not limited to such a configuration. The intake valve and exhaust valve may be single valves and the valve timing and valve lift difference of these valves may be different. Only the valve timing or valve lift distance may be different.

As shown in FIG. 13, the intake valve operating mechanism 48 has a cam-side first rocker arm 83 and cam-side second rocker arm 93 but these arms may be dispensed with and first pushrods 84 and 94 may be directly driven by a first cam 82 and a second cam 92. In this case, a structure equivalent to the projection 83*a* of the cam-side first rocker arm 83, the adjustment bolt 102, and the lock nuts 103 and 104 can be provided to the first pushrod 84, and a structure equivalent to the projection 93*d* of the cam-side second rocker arm 93 can be provided to the second pushrod 94.

Obviously, various minor changes and modifications of the present invention are possible in light of the above teaching. It is therefore to be understood that within the scope of the appended claims the invention may be practiced otherwise than as specifically described.

What is claimed is:

1. A valve-operating mechanism for an internal combustion engine having a cylinder head, a combustion chamber, and intake and exhaust ports, comprising:

intake and exhaust valves adapted to be disposed in the cylinder head for respectively opening and closing the intake and exhaust ports which are designed to communicate with the combustion chamber, each of the intake and exhaust valves being configured as dual valves having an outer valve and an inner valve, the outer valve having an inner valve aperture extending axially thereof, the inner valve being movably fitted in the inner valve aperture, the outer valve having an inner channel that allows communication between the combustion chamber and the intake and exhaust ports, the inner channel being opened and closed by the inner valve; and valve control members for controlling the opening and closing of the outer valve and inner valve, the valve control members, at least during scavenging, simultaneously closing the outer valves of the intake and exhaust valves to produce a non-overlapping state, and simultaneously opening the inner valves of the intake and exhaust valves to produce an overlapping state, wherein the valve control members respectively opening the inner valve and the outer valve of one of the intake and exhaust valves are rotatable on a same shaft.

2. A valve-operating mechanism for an internal combustion engine having a cylinder head, a combustion chamber, and intake and exhaust ports, comprising:

intake and exhaust valves adapted to be disposed in the cylinder head for respectively opening and closing the intake and exhaust ports that communicate with the combustion chamber, each of the intake and exhaust valves being configured as dual valves having an outer valve and an inner valve, the outer valve having an inner valve aperture extending axially thereof, the inner valve being movably fitted in the inner valve aperture, the outer valve having an inner channel that allows communication between the combustion chamber and the intake and exhaust ports, the inner channel being opened and closed by the inner valve; and valve control members for controlling the opening and closing of the outer valve and inner valve, the valve control members respectively opening the outer valve and the inner valve of the exhaust valve in an exhaust stroke and respectively opening the outer valve and inner valve of the intake valve in an intake stroke, wherein the valve control members respectively opening the inner valve and the outer valve of one of the intake and exhaust valves are rotatable on a same shaft.

3. A valve-operating mechanism for an internal combustion engine having a cylinder with a cylinder head, a combustion chamber, and intake and exhaust ports, comprising:

a plurality of intake valves and an exhaust valve adapted to be disposed in the cylinder head radially relative to an axis of the cylinder for respectively opening and closing the intake and exhaust ports communicating with the combustion chamber; and valve control members for preventing interference between the intake valves by controlling the opening and closing of the intake valves using different valve timings and different lift distances, respectively, wherein each of the intake valves is configured as dual valves having an outer valve and an inner valve, and the valve control members respectively controlling the opening and closing of the inner valve and the outer valve are rotatable on a same shaft.

4. The valve-operating mechanism of claim 3, wherein either of the intake valves and the exhaust valve has a head portion of non-circular shape.

5. The valve-operating mechanism of claim 3, wherein the outer valve with an inner valve aperture passes axially therethrough, and the inner valve is movably fitted in the inner valve aperture, the outer valve having an inner channel for allowing communication between the combustion chamber and the intake and exhaust ports, the inner channel being opened and closed by the inner valve, and the valve control members controlling the opening and closing of the outer valve and the inner valve.

6. A valve-operating mechanism for an internal combustion engine having a cylinder head, comprising:

a camshaft adapted to be disposed in the cylinder head and having a valve-opening cam;

an exhaust valve adapted to be disposed in the cylinder head;

a valve-opening pushrod connected at one end to the camshaft in such a manner as to be driven by the valve-opening cam of the camshaft;

a valve-opening rocker arm connected to an opposite end of the valve-opening pushrod and to the exhaust valve and swingably supported by a rocker shaft mounted to the cylinder head;

a valve-closing pushrod connected at one end to the camshaft in such a manner as to be driven by a valve-closing cam of the camshaft; and a valve-closing rocker arm connected to an opposite end of the valve-closing pushrod and to the exhaust valve and swingably supported by the rocker shaft, wherein one of the valve-opening pushrod and the valve-closing pushrod is formed cylindrically, the other one of the valve-opening pushrod and the valve-closing pushrod is disposed inside the cylindrical pushrod such that the two pushrods are disposed substantially coaxially, so that rotation of the camshaft is converted via the pushrods and the rocker arms to opening/closing actions of the intake and exhaust valves.

7. A valve-operating mechanism for an internal combustion engine having a cylinder head, a combustion chamber, and intake and exhaust ports, comprising: intake and exhaust valves adapted to be disposed in the cylinder head for respectively opening and closing the intake and exhaust ports adapted to communicate with the combustion chamber, the intake and exhaust valves being configured as dual valves having an outer valve and an inner valve, the outer valve having an inner valve aperture extending axially thereof, the inner valve being movably fitted in the inner valve aperture, the outer valve having an inner channel that allows communication between the combustion chamber and the intake and exhaust ports, the inner channel being opened and closed by the inner valve; and a camshaft adapted to be disposed in the cylinder head, wherein the valve-operating mechanism further comprises:

a first rocker shaft;

an outer valve cam disposed on the camshaft;

an outer valve first rocker arm that makes contact with the outer valve cam for opening and closing the outer valve, the outer valve first rocker arm being swingably supported by the first rocker shaft;

an outer valve pushrod connected at one end to the outer valve first rocker arm;

a second rocker shaft;

an outer valve second rocker arm connected to an opposite end of the outer valve pushrod and to the outer valve and swingably supported by the second rocker shaft;

an inner valve pushrod connected at one end to the inner valve first rocker arm; and an inner valve second rocker arm connected to an opposite end of the inner valve pushrod and to the inner valve and swingably supported by the second rocker shaft, the outer valve first rocker arm and the inner valve first rocker arm having respective drive arms for, when one of the rocker arms is driven by the outer valve cam or the inner valve cam, pushing the other one of the rocker arms to drive the same, one of the outer valve pushrod and the inner valve pushrod being formed cylindrically and the other one of the outer valve pushrod and the inner valve pushrod being disposed inside the cylindrical pushrod so that the two pushrod lie substantially coaxially, the outer valve being driven via the drive arms when the inner valve is opened and closed and the inner valve being driven via the drive arms when the outer valve is opened and closed, so that rotation of the camshaft is converted via the pushrods and the rocker arms to opening/closing actions of the intake and exhaust valves.

8. The valve-operating mechanism of claim 7, further comprising a spring provided between the outer valve and the inner valve for forcibly closing the inner valve against the outer valve.

* * * * *